US011127269B2

(12) United States Patent
Xing et al.

(10) Patent No.: US 11,127,269 B2
(45) Date of Patent: Sep. 21, 2021

(54) SMOKE DETECTING CIRCUIT AND DISPLAY PANEL USING THE SAME

(71) Applicant: UNILUMIN GROUP CO., LTD, Guangdong (CN)

(72) Inventors: Min Xing, Guangdong (CN); Wenlong Fan, Guangdong (CN); Luhong Zhou, Guangdong (CN)

(73) Assignee: UNILUMIN GROUP CO., LTD, Shenzhen (CN)

( * ) Notice: Subject to any disclaimer, the term of this patent is extended or adjusted under 35 U.S.C. 154(b) by 0 days.

(21) Appl. No.: 16/931,388

(22) Filed: Jul. 16, 2020

(65) Prior Publication Data

US 2021/0090416 A1 Mar. 25, 2021

(30) Foreign Application Priority Data

Sep. 24, 2019 (CN) ..... 201910924407.6

(51) Int. Cl.
*G08B 17/10* (2006.01)
*G08B 3/10* (2006.01)
(Continued)

(52) U.S. Cl.
CPC ..... *G08B 17/10* (2013.01); *G08B 3/10* (2013.01); *G08B 17/06* (2013.01); *G08B 26/008* (2013.01)

(58) Field of Classification Search
CPC ..... G08B 17/10; G08B 3/10; G08B 17/06; G08B 26/008; G08B 17/103; G08B 17/107; G08B 17/11
(Continued)

(56) References Cited

U.S. PATENT DOCUMENTS 4,246,635 A 1/1981 Arima
5,107,446 A * 4/1992 Shaw ..... G08B 17/10 340/514
(Continued)

FOREIGN PATENT DOCUMENTS

CN 87204017 U 8/1988
CN 2325908 Y 6/1999
(Continued)

OTHER PUBLICATIONS

1st Office Action of counterpart Chinese Patent Application No. 201910924407.6 dated Oct. 27, 2020.
(Continued)

*Primary Examiner* — John A Tweel, Jr.

(57) ABSTRACT

The present disclosure provides a smoke detecting circuit and a display panel using the smoke detecting circuit. The circuit includes a smoke sensor, a smoke detecting module, and a first switch module. When the circuit is triggered on fire or smoking because of a short circuit, the smoke sensor is able to detect a smoke signal, the smoke detecting module is able to export a controlling signal immediately to control disconnection of the first switch module, cutting off a power source of a load, and protecting the load immediately while an accident happens. The load can be a display panel. The smoke detecting circuit is used for detecting the smoke signal of the display panel, without any additional external multi-function card, which reduces the installation space of the display panel with an easier arrangement of flat cables, and protects the display panel right away from accidents.

16 Claims, 5 Drawing Sheets

(51) Int. Cl.
*G08B 17/06* (2006.01)
*G08B 26/00* (2006.01)

(58) Field of Classification Search
USPC ..... 340/500
See application file for complete search history.

(56) References Cited

U.S. PATENT DOCUMENTS

| | | | | |
|---|---|---|---|---|
| 5,508,568 | A * | 4/1996 | Mammen | H01R 13/6683 307/117 |
| 2014/0184410 | A1* | 7/2014 | Feng | G08B 17/00 340/540 |
| 2015/0077243 | A1 | 3/2015 | Hooper et al. | |

FOREIGN PATENT DOCUMENTS

| | | | |
|---|---|---|---|
| CN | 2912158 | Y | 6/2007 |
| CN | 102122164 | A | 7/2011 |
| CN | 103050939 | A | 4/2013 |
| CN | 102750896 | B | 12/2015 |
| CN | 110648487 | A | 1/2020 |
| GB | 1489128 | A | 10/1977 |
| JP | S50114999 | A | 9/1975 |
| JP | H10133589 | A | 5/1998 |
| RU | 2667152 | C1 | 9/2018 |

OTHER PUBLICATIONS

2nd Office Action of counterpart Chinese Patent Application No. 201910924407.6 dated Jun. 15, 2021.
Chunyan Liu et al., Electronic Technology Fundamentals, National Defense Industry Press, Mar. 2016, Cover pp. 1-3 and pp. 61-63.
Search report of counterpart European Patent Application No. 20185440.3 dated Feb. 19, 2021.
1st Office Action of counterpart Russian Patent Application No. 2020124821 dated Feb. 2, 2021.

* cited by examiner

SMOKE DETECTING CIRCUIT AND DISPLAY PANEL USING THE SAME

CROSS-REFERENCE TO RELATED APPLICATIONS

The present application claims the benefits of: Chinese Patent Application with No. 201910924407.6, which is filed on Sep. 24, 2019, and the entire disclosure of which is hereby incorporated by reference, in its entirety, for all that it teaches and for all purposes.

FIELD

The present disclosure is related to the field of displaying technology, especially related to a smoke detecting circuit and a display panel using the same smoke detecting circuit.

BACKGROUND

In the recent years, the industry of LED (Light Emitting Diode) display panel has gained continuous development with applications spread wider and wider. However, there may be some errors occurring when the LED display panel is under operation, for instance: excessive electric current, short circuit, overheated temperature, etc, which may lead the display panel to catch fire or smoke, making negative effects on the safety of using LED display panels.

For the time being, in order to improve the safety performance of LED display panel, a solution usually used is to set a multi-function card in the LED display panel to detect its operation circumstances. However, the method raises up the production cost for requiring one more multi-function card and bigger installation space, and moreover, a multi-function card has a more complicated wire arrangement, creating disadvantages for the LED display panel wire arrangement. Furthermore, setting up multi-function card is merely in determining to test the circumstances of the display panel, for instance: to test the temperature of the display panel, to give warning alert while getting abnormal situations detected, which could not protect the display panel immediately.

Another solution is to set up a temperature sensor in the display panel, in order to export a voltage to compare with a basic standard voltage through detecting the temperature of the LED display panel. A warning alert will ring when the temperature is at an abnormal level. However, in the display panel industry, the operating temperatures of the display panels from different factories differ from each other, leading to different temperature determining standards. It may accidentally activate the warning alert by determining whether the display panel is operating normally through detecting the temperature of the display panel. Meanwhile, this solution could not protect the display panel immediately as well.

SUMMARY

Therefore, it is necessary to provide a smoke detecting circuit and display panel using the same smoke detecting circuit, aiming to solve the problems existing in the traditional detecting circuit: complicating wire arrangement, high cost, and failure of protecting the LED display panel immediately.

In one embodiment, a smoke detecting circuit includes: a smoke sensor, a smoke detecting module and a first switch module. The smoke sensor is connected with an input terminal of the smoke detecting module, an output terminal of the smoke detecting module is connected with a controlling terminal of the first switch module, a first terminal of the first switch module is connected with a load, and a second terminal of the first switch module is connected with a power source. The smoke sensor is configured to generate an electric signal upon detecting a smoke signal, and transmit the electric signal to the smoke detecting module. The smoke detecting module is configured to control the disconnection of the first switch module according to the electric signal.

In one embodiment, the first terminal of the first switch module is connected with an adaptor of a display panel, the smoke sensor is set within the display panel and configured to detect a smoke signal from inside the display panel.

In one embodiment, the first switch module includes: a PMOS tube, a first resistor R1 and a second resistor R2, an output terminal of the smoke detecting module is connected with a first terminal of the first resistor R1, a second terminal of the resistor R1 is connected with a driving power source, the first terminal of the first resistor R1 is connected with a first terminal of the second resistor R2, a second terminal of the second resistor R2 is grounded, the first terminal of the first resistor R1 is connected with a grid electrode of the PMOS tube Q2, a drain electrode of the PMOS tube Q2 is connected with the adaptor, the source electrode of the PMOS tube Q2 is connected with a power source, wherein the value of resistance of the first resistor R1 is larger than the value of resistance of the second resistor R2.

In one embodiment, the first switch module includes a first switch Q1 and a second switch Q2, a controlling terminal of the first switch Q1 is connected with the output terminal of the smoke detecting module, a first terminal of the first switch Q1 is connected with a driving power source, a second terminal of the first switch Q1 is connected with the ground, the first terminal of the first switch Q1 is also connected with a controlling terminal of the second switch Q2, a first terminal of the second switch Q2 is connected with the adaptor, and a second terminal of the second switch Q2 is connected with a power source.

In one embodiment, the first switch is an audion Q1, the second switch is a field-effect tube Q2, a base electrode of the audion Q1 is connected with the output terminal of the smoke detecting module, a collector electrode of the audion Q1 is connected with a driving power source, an emitting electrode of the audion Q3 is connected with the ground, the collector electrode of the audion Q1 also is connected with a grid electrode of the field-effect tube Q2, a source electrode of the field-effect tube Q2 is connected with the power source, a drain electrode of the field-effect tube Q2 is connected with the adaptor.

In one embodiment, the smoke detecting module also includes a second switch module and an indication module, a first terminal of the indication module is connected with a power source, a second terminal of the indication module is connected with a first terminal of the second switch module, a second terminal of the second switch module is connected with the ground, the output terminal of the smoke detecting module is connected with a controlling terminal of the second switch module.

In one embodiment, the indication module is a buzzer, a first terminal of the buzzer is connected with a power source, a second terminal of which is connected with the first terminal of the second switch module.

In one embodiment, a smoke detecting circuit also includes a voltage stabilizing diode, a positive electrode of the voltage stabilizing diode is connected with the second terminal of the buzzer, a negative electrode of the voltage stabilizing diode is connected with the first terminal of the buzzer.

In one embodiment, the smoke detecting circuit also includes a pull-down resistor R3, through which the output terminal of the smoke detecting module is connected with the ground.

A display panel, including an adaptor and a smoke detecting circuit from any of the embodiments above, the first terminal of the first switch module is connected with the adaptor, the second terminal of the first switch module is connected with a power source, the smoke sensor is configured to detect the smoke signal of the display panel.

DETAILED DESCRIPTION OF THE EMBODIMENTS

Figure 1:
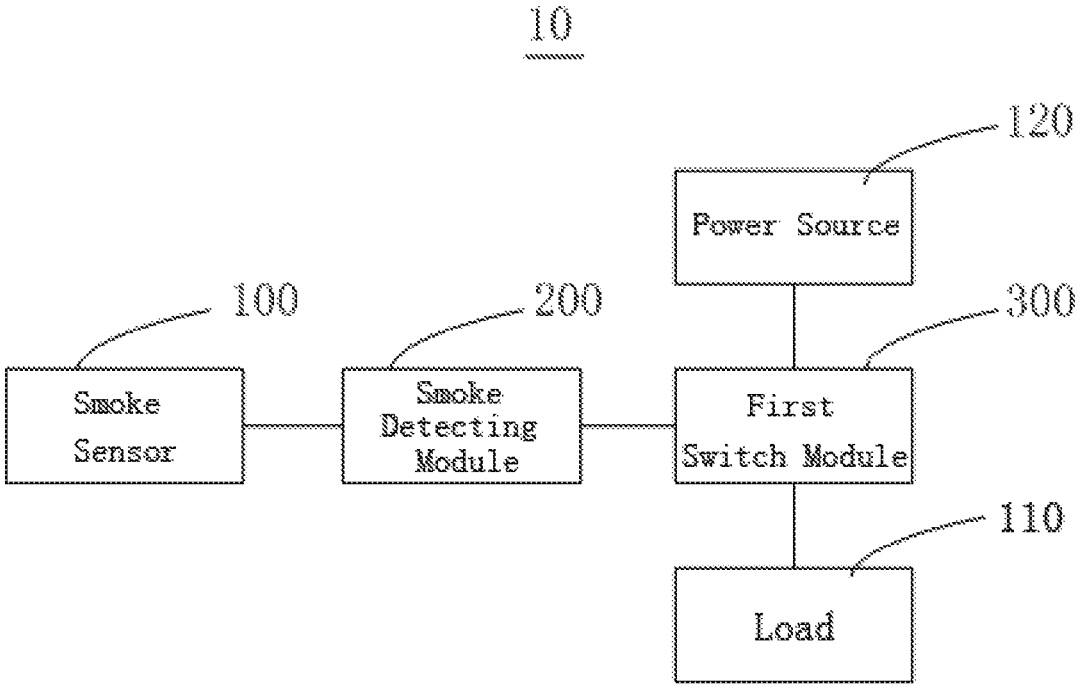
FIG. 1 is a structure block diagram showing functional modules of a smoke detecting circuit according to one embodiment of the present disclosure.

In order to better interpret the present disclosure, the following section will provide a more comprehensive description referring to the related figures. The related figures provide preferable embodiments of the present disclosure. However, the present disclosure could be implemented by a lot of different ways, not limited to the embodiments in this article. On the contrary, the purpose of providing these embodiments is to create better understanding of the contents of the present disclosure.

It should be noted that, when a component is called to be 'fastened' to another component, it can be either directly attached on the other component or there is a media component in the middle. When one component is considered to be 'connected with' another component, it can be either directly connected with the other component or there may be a media component in the middle simultaneously. The terminologies used in this article like 'vertical'. 'horizontal', 'left'. 'right' and some similar expressions is merely for the illustrating purpose, not the only way to execute the embodiment.

All of the technical and science terminologies used in this article are sharing the same interpretation with those used by the technicians in the same technical field of the present disclosure, except there is another specific definition. The technical terminologies used in this article is merely for describing the detailed execution method of the embodiment, without any intention of setting any limit for the present disclosure. The terminologies 'and/or' used in this article comprises any and all of the combinations of a single or multiple related listed objects.

For instance, a smoke detecting circuit is provided, including: a smoke sensor, a smoke detecting module, and a first switch module. The smoke sensor is connected with a controlling terminal of the smoke detecting module, an output terminal of the smoke detecting module is connected with a controlling terminal of the first switch module, a first terminal of the first switching module is connected with a load, a second terminal of the first switch module is connected with a power source, the smoke sensor generates an electric signal when it detects smoking signal, and transmits the generated electric signal to the smoke detecting module, which controls the disconnection of the first switch module according to the electric signal from the smoke detecting module, in order to cut the electricity for the load.

The smoke detecting circuit mentioned above, when the load is caught in fire or smoking because of the short circuit, the smoke sensor can detect the smoke signal, then the smoke detecting module can output a controlling signal immediately to disconnect the first switch module, aiming at cutting the electricity for the load, protecting the load immediately from accidents without requiring workers to be present at the scene and cut off the power source physically, which prevents the fire from occurring and spreading. It can be interpreted as, this smoke detecting circuit can be applied on a display panel, for instance, the load is a display panel, again for instance, the load is an adaptor in the display panel. The smoke detecting circuit is to detect the smoking signal, unnecessary to add an external multi-function card, which reduces the installation space of the display panel, simplifies the wire arrangement, and is able to protect the display panel immediately.

In one embodiment, please refer to FIG. 1, a smoke detecting circuit 10 includes a smoke sensor 100, a smoke detecting module 200, and a first switch module 300. The smoke sensor 100 is connected with an input terminal of the smoke detecting module 200, an output terminal of the smoke detecting module 200 is connected with a controlling terminal of the first switch module 300, a first terminal of the first switch module 300 is connected with a load 110, a second terminal of the first switch module 300 is connected with the power source 120. The smoke sensor 100 generates an electronic signal when having smoking signal detected, and transmits the electric signal to the smoke detecting module 200, which is used to control the disconnection of the first switch module 300 according to the electric signal received.

To be specific, a smoke sensor is a sensor that is determining to detect smoke. When there is smoke detected by the smoke sensor, it generates an electric signal and transmits the electric signal to the smoke detecting module. This embodiment detects the smoke signal of the load and the surrounding of the load, when the smoke sensor detects smoke, the smoke detecting module can disconnect the load from the power source immediately, which better protects the load.

To be specific, a smoke detecting module includes a smoke detecting chip and its surrounded circuit. In one embodiment, the modal number of the smoke detecting chip is MC145018. The smoke detecting module is collaborating with the smoke sensor. When there is smoke detected by the smoke sensor, the smoke detecting module exports a VCC high level signal, in order to control the disconnection between the first terminal and the second terminal of the first switch module. What's more, the first switch module mentioned above can either be one single switch or a component combination with multiple switches. As long as the first switch module is conducted under the low level, and cut-off under the high level, which is to say, the first switch module merely need to reach the requirement that when the smoke detecting module is exporting high level signal, the first terminal and the second terminal of the first switch module disconnect with each other; when the smoke detecting module is exporting low level signal, the first terminal and the second terminal of the first switch module conduct with each other.

The smoke detecting circuit mentioned above, when a load is triggered on fire or smoking because of a short circuit, the smoke sensor can detect smoke signal, the smoke detecting module can output a controlling signal immediately to disconnect the first switch module, aiming at cutting the electricity for the load, protecting the load immediately from accidents without requiring workers to be present at the scene and cut off the power source physically. It can be interpreted as, this smoke detecting circuit can be applied on a display panel, for instance, the load is a display panel, again for instance, the load is an adaptor in the display panel, the smoke detecting circuit is to detect the smoking signal, unnecessary to add an external multi-function card, which reduces the installation space of the display panel, simplifies the wire arrangement, and is able to protect the display panel immediately.

In an embodiment, a smoke detecting circuit is applied in a display panel, the first terminal of the first switch module is connected with an adaptor of the display panel, that said, the load mentioned above is referring to the adaptor in the display panel.

Figure 2:
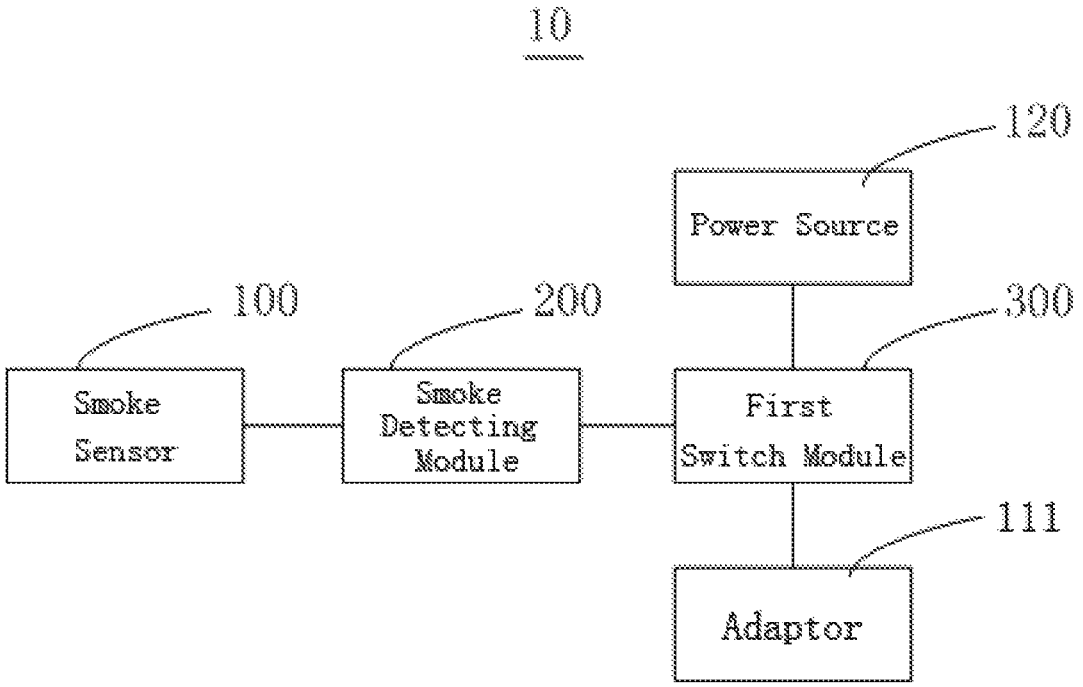
FIG. 2 is a structure block diagram showing functional modules of a smoke detecting circuit according to another embodiment of the present disclosure.

In order to better protect a smoke detecting circuit and the display panel, in one embodiment, please refer to FIG. 2, a first terminal of a first switch module 300 is connected with an adaptor 111 of a display panel, a smoke sensor 100 is set in the display panel, and configured for detecting the smoke signal inside the display panel. In one embodiment, a first terminal of the first switch module 300 is connected with a power supplying terminal of the adaptor 111. In one embodiment, a smoke detecting circuit 10 is set inside the display panel, specifically, an adaptor 111 is referring to a HUB card, also called a pinboard. In a LED display panel, an adaptor is used to send display data and driving data to a display module. According to the display data and the driving data received, the display module executes to display pictures. In this embodiment, by connecting the first terminal of the first switch module of the smoke detecting circuit with the adaptor, when the circuit inside the display panel is triggered on fire or smoking, the smoke sensor detects the smoke signal, the first switch module is controlled to be disconnected, resulting in the disconnection between the adaptor and a power source, and the cut-off of power for the adaptor. Therefore, the data could not be sent to the display module by the adaptor, the display module stop operating. With the power source being cut off immediately, workers won't be necessary to get to the scene to turn off the power source physically, preventing the occurring and spreading of fire, better protecting the display panel. Furthermore, the smoke detecting circuit can be integrated on the adaptor, the smoke detecting circuit occupies less space in the display panel, makes it unnecessary to connect an external multi-function card, and reduce the wire amount of the display panel, thereby reducing the rate of fire accidents due to short circuit of complicated arrangement of flat cables. Besides, comparing with the method of temperature detection for the display panel, smoke detection won't be effected by the temperature differences of the display panel, which is more accurate. More importantly, the supply voltage of the adaptor is about 5V. Connecting the first terminal of the first switch module with the adaptor allows the smoke detecting circuit to be unnecessary to connect with the strong electricity wire, which better protects the smoke detecting circuit.

In one embodiment, a load is referring to an adaptor inside a display panel. In one embodiment, a first terminal of the first switch module is connected with a power supplying terminal of the adaptor.

In one embodiment, the first switch module includes a PMOS (P-channel Metal Oxide Semiconductor) tube Q2, a resistor R1 and a resistor R2, an output terminal of the smoke detecting module is connected with a first terminal of the resistor R1, a second terminal of the resistor R1 is connected with a driving power source, the first terminal of the resistor R1 is connected with a first terminal of the resistor R2, a second terminal of the resistor R2 is grounded, the first terminal of the resistor R1 is also connected with a grid electrode of the PMOS tube Q2, a drain electrode of the PMOS tube Q2 is connected with the load, a source electrode of the PMOS tube Q2 is connected with the power source. The value of resistance of resistor R1 is larger than that of resistor R2.

Figure 3:
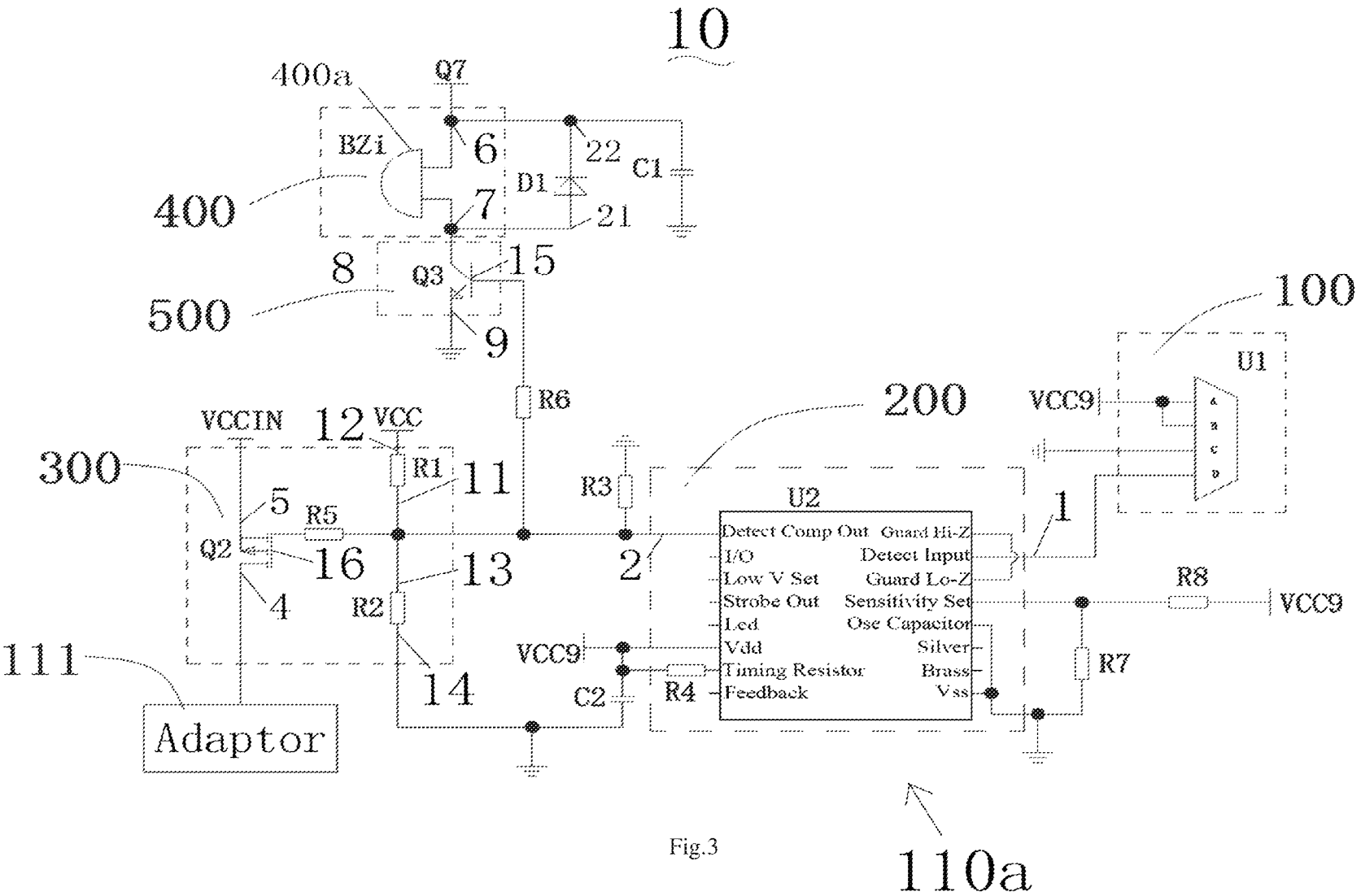
FIG. 3 is a circuit schematic diagram of a smoke detecting circuit according to one embodiment of the present disclosure.

In one embodiment, please refer to FIG. 3, the first switch module 300 includes a PMOS tube Q2, a resistor R1 and a resistor R2, the output terminal 2 of the smoke detecting module 200 is connected with a first terminal 11 of the resistor R1, a second terminal 12 of the resistor R1 is connected with the driving power source VCC, the first terminal 11 of the resistor R1 is connected with a first terminal 13 of the resistor R2, a second terminal 14 of the resistor R2 is grounded, the first terminal 11 of the resistor R1 is also connected with a grid electrode 16 of the PMOS tube Q2, a drain electrode 4 of the PMOS tube Q2 is connected with the adaptor 111, a source electrode 5 of the PMOS tube Q2 is connected with the power source VCCIN. The value of resistance of the resistor R1 is larger than the one of the resistor R2. In one embodiment, the value of resistance of the resistor R1 is 5 times to 15 times as large as the one of the resistor R2. Specifically, when the grid electrode 16 of the PMOS (Positive Channel Metal Oxide Semiconductor) tube Q2 is connected with the low level signal, the PMOS tube is in a conducted state. When the grid electrode 16 of the PMOS tube Q2 is connected with the high level signal, the PMOS tube Q2 is in a cut-off state. The resistor R1 and the resistor R2 play the role of voltage splitting. When the smoke sensor 100 does not yet detect the smoke signal, the smoke detecting module 200 exports a low level signal. For the value of resistance of the resistor R1 is larger than the one of the resistor R2, the value of voltage of the resistor R1 is larger than that across the resistor R2. Under this circumstance, the first terminal 11 of the resistor R1, and the grid electrode 16 of the PMOS tube Q2 receive a low level signal, the PMOS tube Q2 is in a conducted state. However, when the smoke sensor 100 detects any smoke signal, the smoke detecting module 200 exports a high level signal. Under this circumstance, the grid electrode 16 of the PMOS tube Q2 receives a high level signal, the PMOS tube Q2 is in a cut-off state, which means that the drain electrode 4 of the PMOS tube Q2 is disconnected with the source electrode 5. So, through setting up a first switch module 300 like described above, it can also realize to cut off the power source of the adaptor 111 while having smoke detected, to have the adaptor 111 working normally while having no smoke detected, which is better protecting the display panel 110*a*. Besides, the first switch module 300 only requires one switch tube Q2, which tremendously reduces the producing cost of the first switch module 300.

Figure 4:
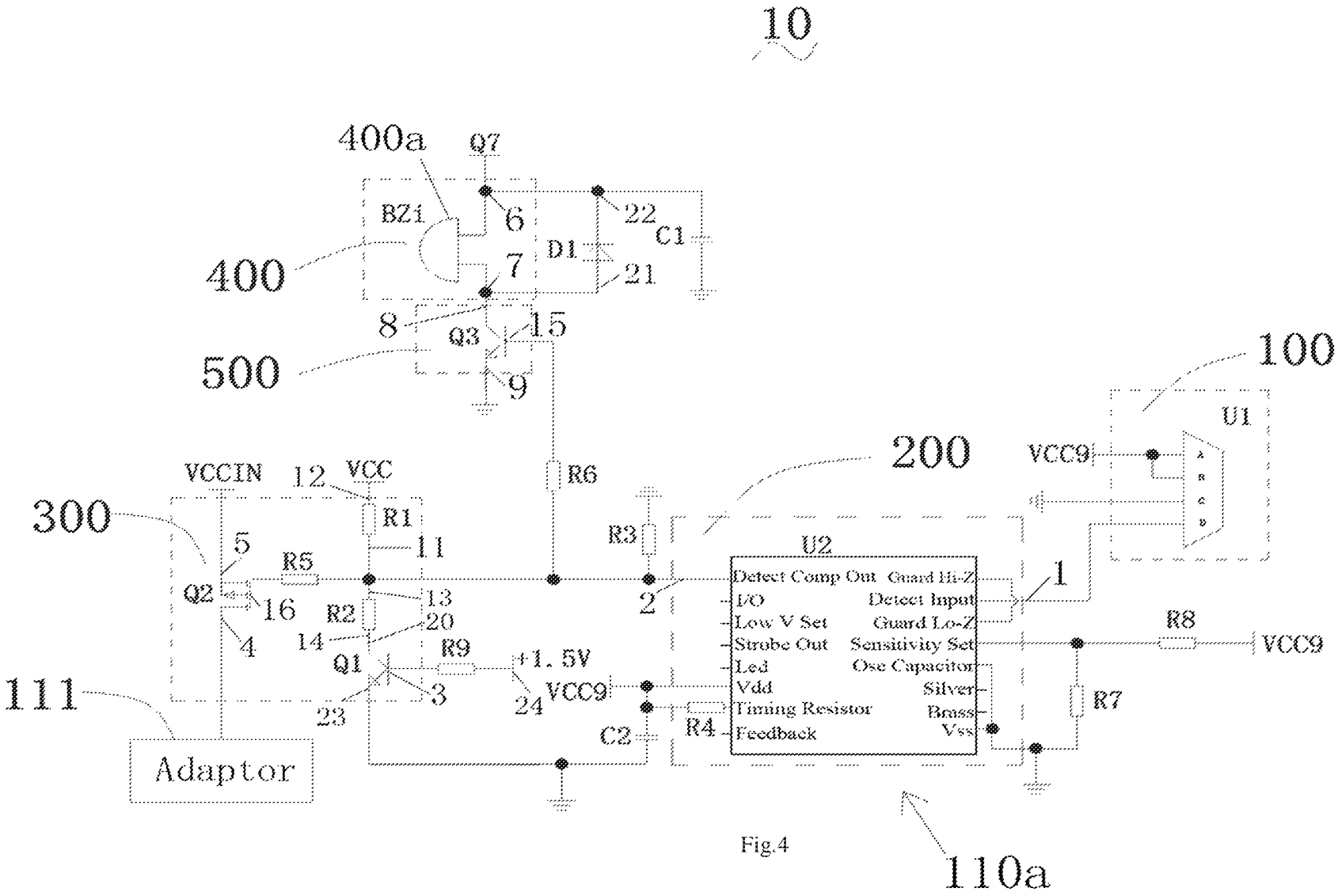
FIG. 4 is a circuit schematic diagram of a smoke detecting circuit according to another embodiment of the present disclosure.

In one embodiment, please refer to the FIG. 4, the first switch module 300 also includes an audion Q1, a base electrode 3 of the audion Q1 is connected with a controlling power source 24, a collector electrode 20 of the audion Q1 is connected with the second terminal 14 of the resistor R2, an emitting electrode 23 of the audion Q1 is grounded. Specifically, through setting up an audion Q1, it makes the grid electrode 16 of the PMOS tube Q2 stably be connected to the low level signal while there is no smoke signal detected by the smoke sensor 100. Thus it prevents the display panel 110*a* from having a splash screen.

In one embodiment, the first switch module includes a first switch Q1 and a second switch Q2, a controlling terminal of the first switch Q1 is connected with the output terminal of the smoke detecting module, a first terminal of the first switch is configured to connect the driving power source, a second terminal of the first switch is grounded, the first terminal of the first switch is connected with a controlling terminal of the second switch, a first terminal of the second switch is connected with to the load, a second terminal of the second switch is connected with the power source.

Figure 5:
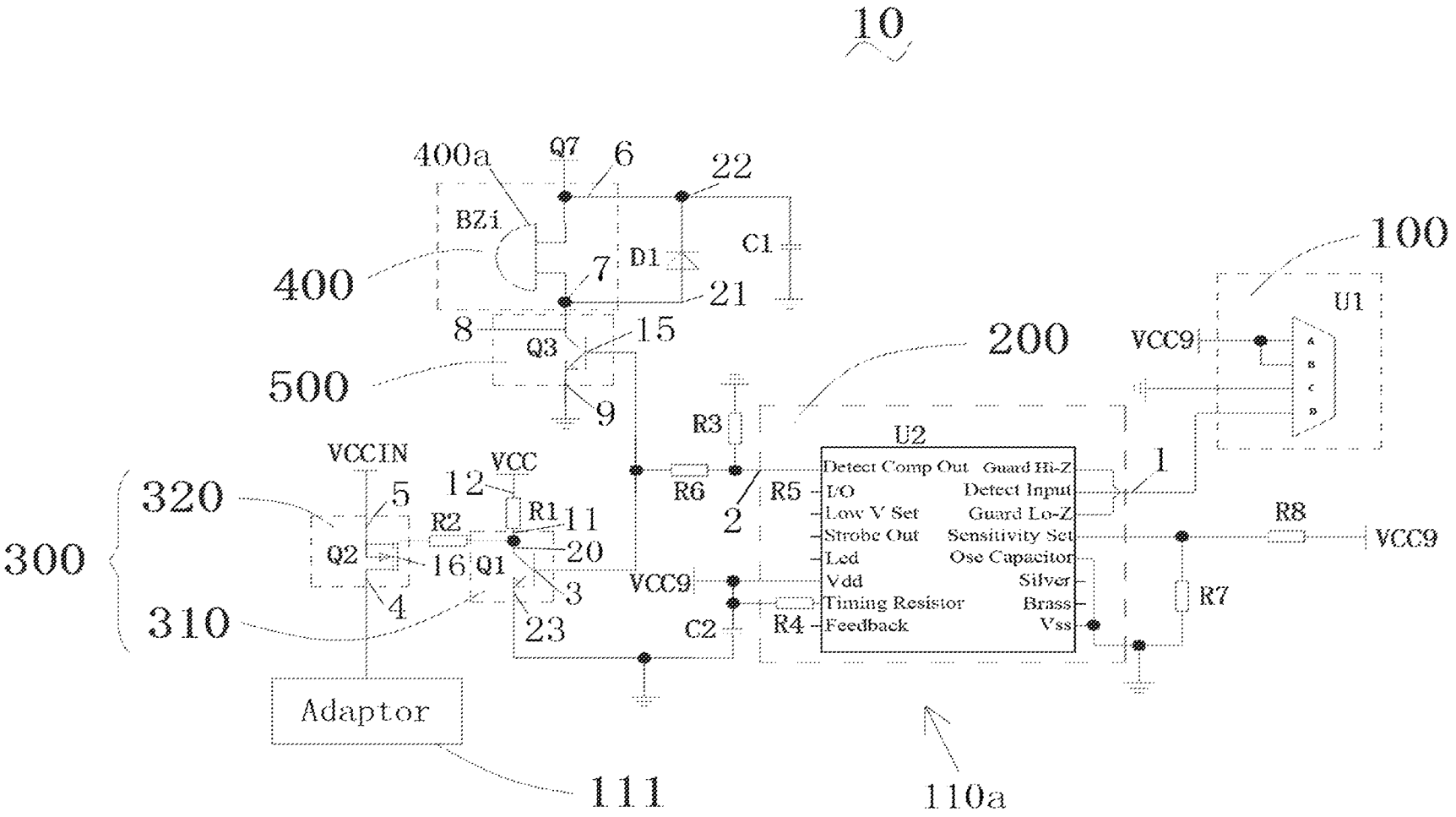
FIG. 5 is a circuit schematic diagram of a smoke detecting circuit according to still another embodiment of the present disclosure.

In order to better perform that to have the first terminal and the second terminal of the first switch module disconnected while having the smoke detected, in one embodiment, please refer to the FIG. 5, the first switch module 300 includes a first switch 310 and a second switch 320. A controlling terminal 3 of the first switch 310 is connected with the output terminal 2 of the smoke detecting module 200, a first terminal 20 of the first switch 310 is connected with the driving power source VCC, and a second terminal 23 of the first switch 310 is grounded. The first terminal 20 of the first switch 310 is connected with a controlling terminal 16 of the second switch 320, a first terminal 4 of the second switch 320 is connected with the adaptor 111, and a second terminal 5 of the second switch 320 is connected with to the power source VCCIN. In this embodiment, the first switch and the second switch are conducted while receiving a high level signal, on the other hand, cut off while receiving a low level signal. Specifically, when the smoke sensor detects the smoke signal, the smoke detecting module exports a high level signal to control the conduction of the first switch, the driving power source is grounded through the first switch. Under this circumstance, the controlling terminal of the second switch receives a low level signal, the first terminal and the second terminal of the second switch are disconnected. When the smoke sensor has not detected any smoke signal, the smoke detecting module exports a low level signal, the first switch Q1 is disconnected, the driving power source provides a high level signal to the controlling terminal of the second switch, conducting the first terminal and the second terminal of the second switch. Therefore, through setting up a first switch module like this, it realizes that when there is smoke detected, the power source of the adaptor will be cut off, however, when there is no smoke detected, the adaptor works normally, which better protects the display panel.

In one embodiment, please refer to the FIG. 5, the first switch 310 is an audion Q1, the second switch 320 is a field-effect tube Q2, a base electrode 3 of the audion Q1 is connected with the smoke detecting module 200, a collector electrode 20 of the audion Q1 is connected with the driving power source VCC, an emitting electrode 23 of the audion Q1 is grounded, the collector electrode 20 of the audion Q1 is also connected with a grid electrode 16 of the field-effect tube Q2, a source electrode 5 of the field-effect tube Q2 is connected with the power source VCCIN, a drain electrode 4 of the field-effect tube Q2 is connected with the adaptor 111. In one embodiment, the drain electrode 4 of the field-effect tube Q2 is connected with the adaptor. Specifically, the field-effect tubes Q2 and the audion Q1 are both switch tube with switching feature. When there are smoke signals detected by the smoke sensor, the smoke detecting module controls the audion Q1 to be conducted. the grid electrode of the field-effect tube Q2 receives a low level signal to cut off the field-effect tube Q2. When there is no smoke signal detected by the smoke sensor, the smoke detecting module controls the audion Q1 to be cut off. the grid electrode of the field-effect tube Q2 receives a high level signal, the field-effect tubes are conducted, in order to meet the control requirement of the smoke detecting circuit. Besides, a field-effect tube consumes less power than an audion, however, an audion costs less than a field-effect tube. Through setting up the first switch as an audion, the second switch as a field-effect tube, and connecting the field-effect tube with the adaptor, it not only reduces the effect to the electricity supply of the adaptor, but also reduces the production cost of the first switch module.

In one embodiment, a first switch module includes a switch and an inverter, an input terminal of the inverter is connected with an output terminal of the smoke detecting module. An output terminal of the inverter is connected with a controlling terminal of the switch. A first terminal of the switch is connected with the adaptor. A second terminal of the switch is connected with the power source. Specifically, when there are smoke signals detected by the smoke sensor, the smoke detecting module exports a high level signal. The high level signal is converted to be a low level signal through the inverter, thereby conducting the first terminal and the second terminal of the switch. So that, through setting up a first switch module like this, it can also realize that when there is smoke detected, the power source of the adaptor will be disconnected, when there is no smoke detected, the adaptor works normally, which better protects the display panel.

Figure 6:
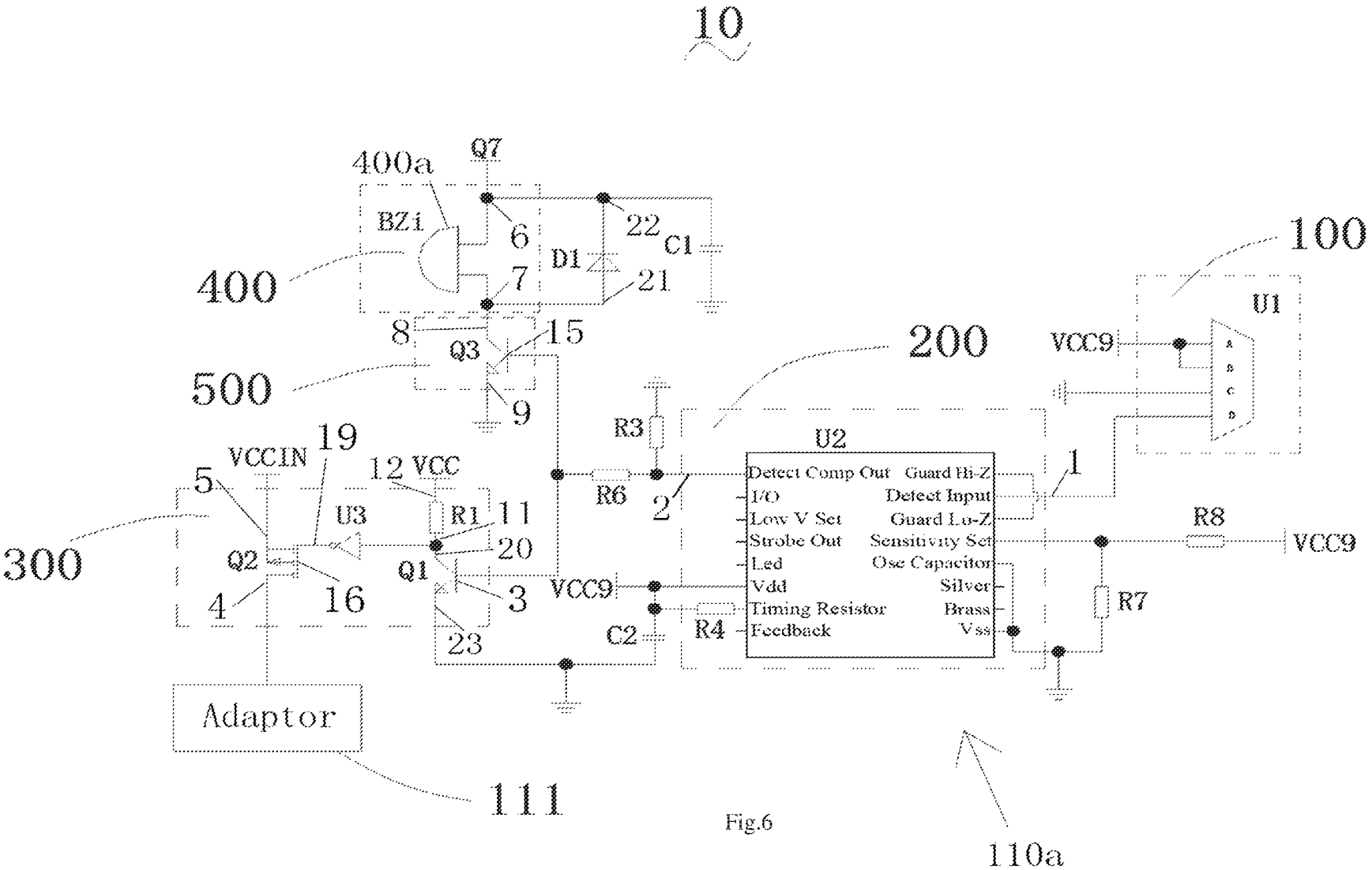
FIG. 6 is a circuit schematic diagram of a smoke detecting circuit according to still another embodiment of the present disclosure.

In one embodiment, please refer to the FIG. 6, the first switch module 300 includes an audion Q1, an inverter U3 and a PMOS tube Q2. A base electrode 3 of the audion Q1 is connected with the smoke detecting module 200, a collector electrode 20 of the audion Q1 is connected with the driving power source VCC, an emitting terminal 23 of the audion Q1 is connected with the ground, the collector electrode 20 of the audion Q1 is connected with the inverter U3, an output terminal 19 of the inverter U3 is connected with a grid electrode 16 of the PMOS tube Q2, a source electrode 5 of the PMOS tube Q2 is connected with the power source VCCIN, a drain electrode 4 of the PMOS tube Q2 is connected with the adaptor 111. For the first switch module mentioned above, the PMOS tube is conducted by a low level signal, so by setting up an inverter on the grid electrode of the PMOS tube, it can still control the PMOS tube to be disconnected while the smoke sensor detects a smoke signal.

To let the workers better discover the errors of the load or the display panel, in one embodiment, the smoke detecting circuit also includes an indication module, the indication module is connected with the output terminal of the smoke detecting module, specifically, when the smoke sensor detects the smoke signal, the smoke detecting module exports a related controlling signal, leading the indication module to export indicating signal in order to better help the workers to discover the errors occurring in the load and the display panel.

In one embodiment, please refer to the FIG. 5, the smoke detecting circuit 10 also includes a second switch module 500 and an indication module 400, a first terminal 6 of the indication module 400 is connected with the power source C1, a second terminal 7 of the indication module 400 is connected with the first terminal 8 of the second switch module 500, the second terminal 9 of the second switch module 500 is connected with the ground, the output terminal 2 of the smoke detecting module 200 is connected with a controlling terminal 15 of the second switch module 500. In one embodiment, the second switch module 500 is an audion Q3, a base electrode 15 of the audion Q3 is connected with the output terminal 2 of the smoke detecting module 200, a collector electrode 8 of the audion Q3 is connected with the second terminal 7 of the indication module 400, an emitting electrode 9 of the audion Q3 is grounded. In this embodiment, when the smoke sensor detects the smoke signal, the output of the smoke detecting module exports high level signal to control and conduct the first terminal and the second terminal of the second switch module, getting the electricity go through the indication module, producing the indicating signal, reminding the workers of the errors occurring in the load or the display panel. Besides, through setting up the second switch module, the power supply circuit of the indication module is isolated from the output terminal of the smoke detecting module, preventing the power supply circuit of the indication module from interrupting the smoke detecting module to export controlling signal, which increases the detection accuracy of the smoke detecting circuit.

In one embodiment, the indication module is a buzzer, the first terminal of the buzzer is used to connect the power source, the second terminal of the buzzer is connected with the first terminal of the second switch module.

To better protects the buzzer, in one embodiment, please refer to the FIG. 5, the smoke detecting circuit 10 also includes a voltage stabilizing diode D1, a positive electrode 21 of the voltage stabilizing diode D1 is connected with the second terminal 7 of the buzzer 400*a*, a negative electrode 22 of the voltage stabilizing diode D1 is connected with the first terminal 6 of the buzzer 400*a*. Specifically, a buzzer is usually made of inductance components, when the inductance components suddenly got power on or power off, it will produce a lot of induced electromotive force, the induced electromotive force will damage the inductance components easily, which means that the buzzer will be damaged easily. Since the voltage stabilizing diode is useful for stabilizing the voltage, the components connecting with the voltage stabilizing diode will have stable voltage, therefore, the buzzer can be better protected by parallel connecting a voltage stabilizing diode with it.

In order to prevent the buzzer from accidentally making alert, in one embodiment, please refer to the FIG. 5, the smoke detecting circuit 10 also includes a pull-down resistor R3, the output terminal 2 of the smoke detecting module 200 is grounded through the pull-down resistor R3. Specifically, the purpose of the pull-down resistor R3 is to connect an uncertain signal to ground, to keep it at a low level. To connect a pull-down resistor R3 with the output terminal of the smoke detecting module means to connect a pull-down resistor R3 with the controlling terminal of the second switch module. When the smoke sensor has not detected any smoke signal, the controlling terminal of the second switch module receives the low level signal stably, leading the second switch module to be in the cut-off state, preventing the buzzer from making alert by accident.

In one embodiment, referring to FIGS. 3-6, a display panel 110*a* includes an adaptor 111 and a smoke detecting circuit 10 from any of the embodiments above, a first terminal 4 of the first switch module 300 is connected with the adaptor 111, and a second terminal 5 of the first switch module 300 is connected with the power source VCCIN. The smoke sensor 100 is configured to detect the smoke signal in the display panel 110*a*.

Specifically, the smoke sensor 100 is connected with the output terminal 1 of the smoke detecting module 200, the output terminal 2 of the smoke detecting module 200 is connected with the controlling terminal 3 of the first switch module 300, the first terminal 4 of the first switch module 300 is connected with the adaptor 111, the second terminal 5 of the first switch module 300 is connected with the power source VCCIN.

The display panel mentioned above, through connecting the first terminal of the first switch module inside the smoke detecting circuit with the adaptor, when the smoke sensor detects the smoke signal, disconnect the adaptor from the power source, and stop the power supply for the adaptor. Then the adaptor won't be able to transfer data to a display module, thereby, stopping the display module from operating. When circuits inside the display panel are triggered on fire or smoking, the power source will be cut off immediately, which better protects the display panel. Also, this smoke detecting circuit can be integrated on the adaptor, the smoke detecting circuit occupies a little space. Without requiring any add-on multi-function card, it reduces the wire amount inside the display panel, and decreases the rate of being triggered on fire by a short circuit accident of the circuits. Besides, to detect the safety of the display panel usage by the smoke detection prevents the interference caused because of different operation temperatures of the display panel from different factories, making the detection more accurate. More importantly, since the supply voltage of the adaptor is about 5V, to connect the first terminal of the first switch module with the adaptor allows the smoke detecting circuit not to connect with the high voltage, which better protects the smoke detecting circuit.

The embodiments above only disclose a few kinds of implementation of the disclosure, the description is relatively detailed and specific. However, the embodiments can not be interpreted as the limit for the scope of the disclosure. What should be pointed out is that, for the common technicians of this field, under the precondition of not getting out of the idea of the present disclosure, some transformation and improvement can still be implemented, which is also included in the protection scope of the present disclosure. Thereby, the scope of protection of the present disclosure should follow the claims attached as its criterion.

What is claimed is:

1. A smoke detecting circuit, wherein the smoke detecting circuit comprises: a smoke sensor, a smoke detecting module and a first switch module, the smoke sensor is connected with an input terminal of the smoke detecting module, an output terminal of the smoke detecting module is connected with a controlling terminal of the first switch module, a first terminal of the first switch module is connected with a load, and a second terminal of the first switch module is connected with a power source;

the smoke sensor is configured to generate an electric signal upon detecting a smoke signal, and transmit the electric signal to the smoke detecting module;

the smoke detecting module is configured to control the disconnection of the first switch module according to the electric signal;

the first terminal of the first switch module is connected with an adaptor of a display panel;

the first switch module comprises a PMOS tube, a first resistor and a second resistor, an output terminal of the smoke detecting module is connected with a first terminal of the first resistor, a second terminal of the resistor is connected with a driving power source, the first terminal of the first resistor is connected with a first terminal of the second resistor, a second terminal of the second resistor is grounded, the first terminal of the first resistor is connected with a grid electrode of the PMOS tube, a drain electrode of the PMOS tube is connected with the adaptor, a source electrode of the PMOS tube is connected with a power source, wherein a value of resistance of the first resistor is larger than a value of resistance of the second resistor.

2. The smoke detecting circuit of claim 1, wherein the smoke sensor is set within the display panel and configured to detect a smoke signal from inside the display panel.

3. The smoke detecting circuit of claim 1, wherein the first switch module comprises a first switch and a second switch, a controlling terminal of the first switch is connected with the output terminal of the smoke detecting module, a first terminal of the first switch is connected with a driving power source, a second terminal of the first switch is connected with the ground, the first terminal of the first switch is also connected with a controlling terminal of the second switch, a first terminal of the second switch is connected with the adaptor, and a second terminal of the second switch is connected with a power source.

4. The smoke detecting circuit of claim 1, wherein the first switch module comprises a first switch and a second switch, the first switch is an audion, the second switch is a field-effect tube, a base electrode of the audion is connected with the output terminal of the smoke detecting module, a collector electrode of the audion is connected with a driving power source, an emitting electrode of the audion is connected with the ground, the collector electrode of the audion also is connected with a grid electrode of the field-effect tube, a source electrode of the field-effect tube is connected with the power source, a drain electrode of the field-effect tube is connected with the adaptor.

5. The smoke detecting circuit of claim 1, wherein the smoke detecting circuit also comprises a second switch module and an indication module, a first terminal of the indication module is connected with a power source, a second terminal of the indication module is connected with a first terminal of the second switch module, a second terminal of the second switch module is connected with the ground, the output terminal of the smoke detecting module is connected with a controlling terminal of the second switch module.

6. The smoke detecting circuit of claim 1, wherein the smoke detecting circuit also comprises a second switch module and an indication module, a first terminal of the indication module is connected with a power source, a second terminal of the indication module is connected with a first terminal of the second switch module, a second terminal of the second switch module is connected with the ground, an output terminal of a smoke detecting module is connected with a controlling terminal of the second switch module.

7. The smoke detecting circuit of claim 6, wherein the indication module is a buzzer, a first terminal of the buzzer is connected with the power source, a second terminal of the buzzer is connected with the first terminal of the second switch module.

8. The smoke detecting circuit of claim 6, wherein the smoke detecting circuit also comprises a voltage stabilizing diode, a positive electrode of the voltage stabilizing diode is connected with the second terminal of the buzzer, a negative electrode of the voltage stabilizing diode is connected with the first terminal of the buzzer.

9. The smoke detecting circuit of claim 6, wherein the smoke detecting circuit also comprises a pull-down resistor, an output terminal of a smoke detecting module is grounded through the pull-down resistor.

10. A display panel, wherein the display panel comprises an adaptor and a smoke detecting circuit, the smoke detecting circuit comprises: a smoke sensor, a smoke detecting module and a first switch module, the smoke sensor is connected with an input terminal of the smoke detecting module, an output terminal of the smoke detecting module is connected with a controlling terminal of the first switch module, a first terminal of the first switch module is connected with the adaptor, and a second terminal of the first switch module is connected with a power source;

the smoke sensor is configured to generate an electric signal upon detecting a smoke signal from inside the display panel, and transmit the electric signal to the smoke detecting module;

the smoke detecting module is configured to control the disconnection of the first switch module according to the electric signal;

the first switch module comprises a PMOS tube, a first resistor and a second resistor, an output terminal of a smoke detecting module is connected with a first terminal of the first resistor, a second terminal of the first resistor is connected with a driving power source, a first terminal of the first resistor is connected with a first terminal of the second resistor, a second terminal of the second resistor is connected with the ground, the first terminal of the first resistor is connected with a grid electrode of a PMOS tube, a drain electrode of the PMOS tube is connected with the adaptor, a source electrode of the PMOS tube is connected with the power source, wherein a value of resistance of the first resistor is larger than a value of resistance of the second resistor.

11. The display panel of claim 10, wherein the first switch module comprises a first switch and a second switch, a controlling terminal of the first switch is connected with an output terminal of a smoke detecting module, a first terminal of the first switch is connected with a driving power source, a second terminal of the first switch is connected with the ground, the first terminal of the first switch is also connected with a controlling terminal of the second switch, the first terminal of the second switch is connected with the adaptor, and the second terminal of the second switch is connected with the power source.

12. The display panel of claim 10, wherein the first switch module comprises a first switch and a second switch, the first switch of the first switch module is an audion, the second switch of the first switch module is a field-effect tube, a base electrode of the audion is connected with an output terminal of a smoke detecting module, a collector electrode of the audion is connected with the driving power source, an emitting electrode of the audion is connected with the ground, the collector electrode of the audion is also connected with a grid electrode of the field-effect tube, a source electrode of the field-effect tube is connected with the power source, a drain electrode of the field-effect tube is connected with the adaptor.

13. The display panel of claim 10, wherein the smoke detecting circuit also comprises a second switch module and an indication module, a first terminal of the indication module is connected with a power source, a second terminal of the indication module is connected with a first terminal of the second switch module, a second terminal of the second switch module is connected with the ground, an output terminal of a smoke detecting module is connected with a controlling terminal of the second switch module.

14. The display panel of claim 10, wherein an indication module is a buzzer, a first terminal of the buzzer is connected with a power source, a second terminal of the buzzer is connected with a first terminal of a second switch module.

15. The display panel of claim 10, wherein the smoke detecting circuit also comprises a voltage stabilizing diode, a positive electrode of the voltage stabilizing diode is connected with a second terminal of a buzzer, a negative electrode of the voltage stabilizing diode is connected with a first terminal of the buzzer.

16. The display panel of claim 10, wherein the smoke detecting circuit also comprises a pull-down resistor, an output terminal of the smoke detecting module is grounded through the pull-down resistor.

* * * * *